US009136619B2

(12) United States Patent
Hsu

(10) Patent No.: US 9,136,619 B2
(45) Date of Patent: Sep. 15, 2015

(54) ELECTRICAL CONNECTOR ASSEMBLY

(71) Applicant: HON HAI PRECISION INDUSTRY CO., LTD., New Taipei (TW)

(72) Inventor: Shuo-Hsiu Hsu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/288,190

(22) Filed: May 27, 2014

(65) Prior Publication Data

US 2014/0357100 A1 Dec. 4, 2014

(30) Foreign Application Priority Data

May 30, 2013 (TW) ..... 102210071 U

(51) Int. Cl.

| | |
|---|---|
| ***H01R 12/00*** | (2006.01) |
| ***H01R 12/52*** | (2011.01) |
| ***H01R 12/71*** | (2011.01) |
| ***H01R 13/24*** | (2006.01) |

(52) U.S. Cl.
CPC ..... *H01R 12/523* (2013.01); *H01R 12/712* (2013.01); *H01R 13/2442* (2013.01)

(58) Field of Classification Search
CPC ..... H01R 23/722
USPC ..... 439/70, 71
See application file for complete search history.

(56) References Cited

U.S. PATENT DOCUMENTS

| | | | | |
|---|---|---|---|---|
| 6,826,538 | B1 * | 11/2004 | Kalyan et al. | 705/7.25 |
| 7,097,465 | B1 * | 8/2006 | Korsunsky et al. | 439/74 |
| 8,758,064 | B2 * | 6/2014 | Nagase et al. | 439/676 |
| 2004/0185691 | A1 * | 9/2004 | Ma | 439/74 |
| 2014/0141628 | A1 * | 5/2014 | Hsu | 439/67 |
| 2014/0148021 | A1 * | 5/2014 | Hsu | 439/67 |
| 2014/0304985 | A1 * | 10/2014 | Nagase et al. | 29/747 |

FOREIGN PATENT DOCUMENTS

| | | |
|---|---|---|
| TW | M429188 | 5/2012 |

* cited by examiner

*Primary Examiner* — Phuong Dinh
(74) *Attorney, Agent, or Firm* — Ming Chieh Chang; Wei Te Chung

(57) ABSTRACT

An electrical connector assembly (100) includes a first electrical connector for connecting a substrate (300) and a second electrical connector for connecting a package (200), the first electrical connector includes a first insulating housing (1) with a plurality of first contacts (3) and second contacts (4) received therein, the second electrical connector includes a second insulating housing with (2) a plurality of third contacts (5) and fourth contacts (6) received therein, the third contact (5) includes a pair of spring arms (51), the first contact (3) includes a first contacting portion (31) contact with the spring arms (51), the second contact (4) includes a spring portion (41) having a second contacting portion (410), the fourth contact (6) includes a press portion (61) contacting the second contacting portion (410) and press the spring portion (41) to be deformed.

6 Claims, 8 Drawing Sheets

ELECTRICAL CONNECTOR ASSEMBLY

BACKGROUND OF THE INVENTION

1. Field of the Invention

The present invention relates to an electrical connector assembly, and more particularly to an electrical connector assembly having improved contacts.

2. Description of Related Art

TW patent No. M429188 issued to HSU on May 11, 2012 discloses a conventional electrical connector assembly. The electrical connector assembly includes a first insulating housing with a plurality of first contacts received therein and a second insulating housing with a plurality of second contacts received therein. Each of the second contacts includes a pair of spring arms for contacting with the first contact, thus to establish a robust electrical connection between the first contact and the second contact. However, due to each of the second contacts includes a pair of spring arms to hold the first contacts; it is hard to know if all of the second contacts connect with the first contacts.

Hence, it is desirable to provide an improved electrical connector assembly to overcome the aforementioned disadvantages.

SUMMARY OF THE INVENTION

Accordingly, an object of the present invention is to provide an electrical connector assembly having improved contacts to ensure an robust electrical connection.

According to one aspect of the present invention, an electrical connector assembly includes a first electrical connector for connecting a substrate and a second electrical connector for connecting a package, the first electrical connector includes a first insulating housing with a plurality of first contacts and second contacts received therein, the second electrical connector includes a second insulating housing with a plurality of third contacts and fourth contacts received therein, the third contact includes a pair of spring arms, the first contact includes a first contacting portion contact with the spring arms, the second contact includes a spring portion having a second contacting portion, the fourth contact includes a press portion contacting the second contacting portion and press the spring portion to be deformed.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
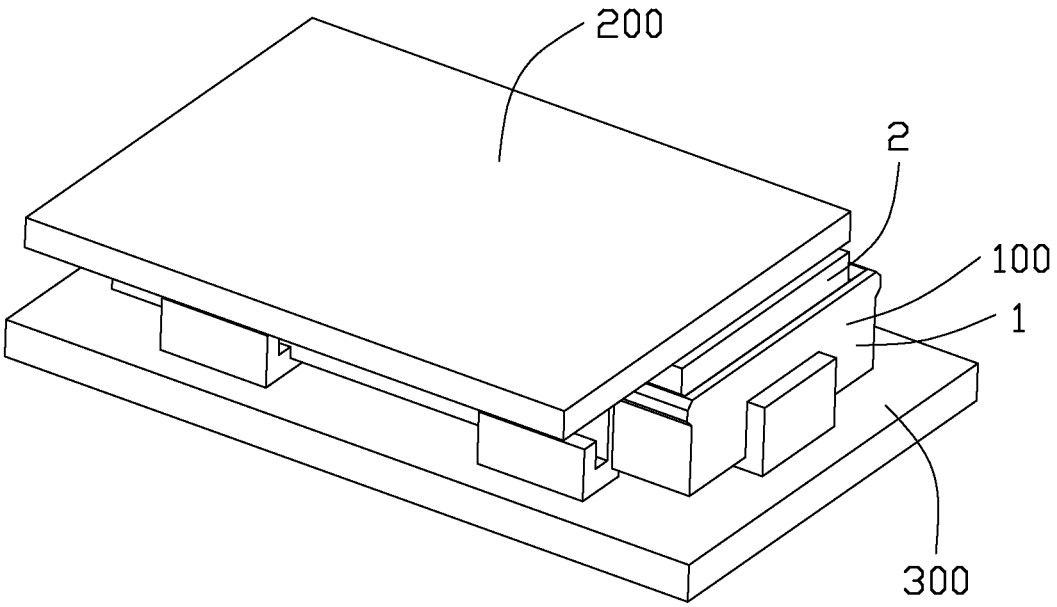
FIG. 1 is an assembled view of an electrical connector assembly with a package and a substrate according to a preferred embodiment of the present invention.

FIG. 1 illustrates an electrical connector assembly 100 in accordance to a preferred embodiment of the present invention, the electrical connector assembly 100 is used to electrically connecting an package 200 with a substrate 300. The electrical connector assembly 100 includes a first electrical connector (not labeled) soldered to the substrate 300 and a second electrical connector (not labeled) soldered to the package 200.

Figure 2:
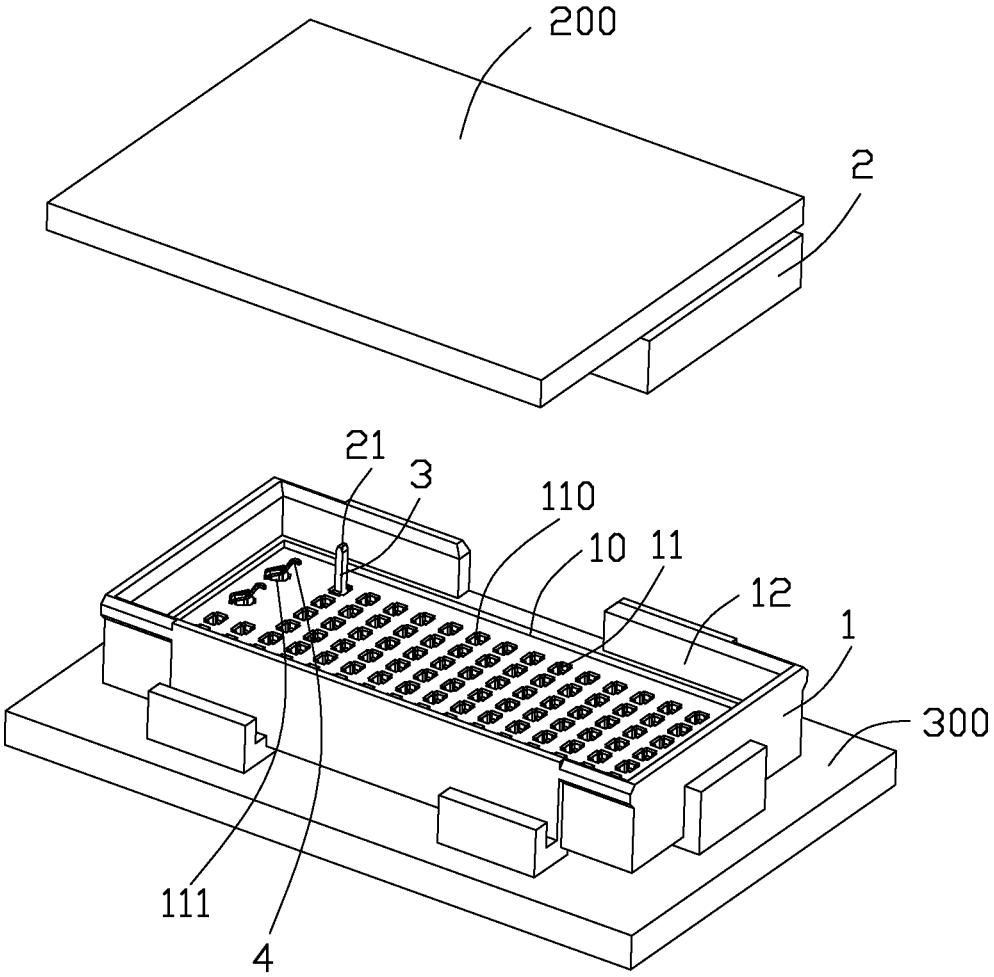
FIG. 2 is an exploded view of the electrical connector assembly as shown in FIG. 1, showing the second electrical connector not assembled to the first electrical connector.

Referring to FIG. 2, the first electrical connector includes a first insulating housing 1, a plurality of first contacts 3 and a plurality of second contacts 4 received in the first insulating housing 1. The first insulating housing 1 includes a main portion 10 and a plurality of sidewalls 12 extending upwardly from the main portion 10. The main portion 10 and the sidewalls 12 form a receiving space (not labeled) for receiving the second insulating housing 2. The main portion 10 includes a plurality of first passageways 110 and a plurality of second passageways 111 penetrating the main portion 10. The first contacts 3 receive in the first passageways 110, the second contacts 4 receive in the second passageways 111.

Figure 5:
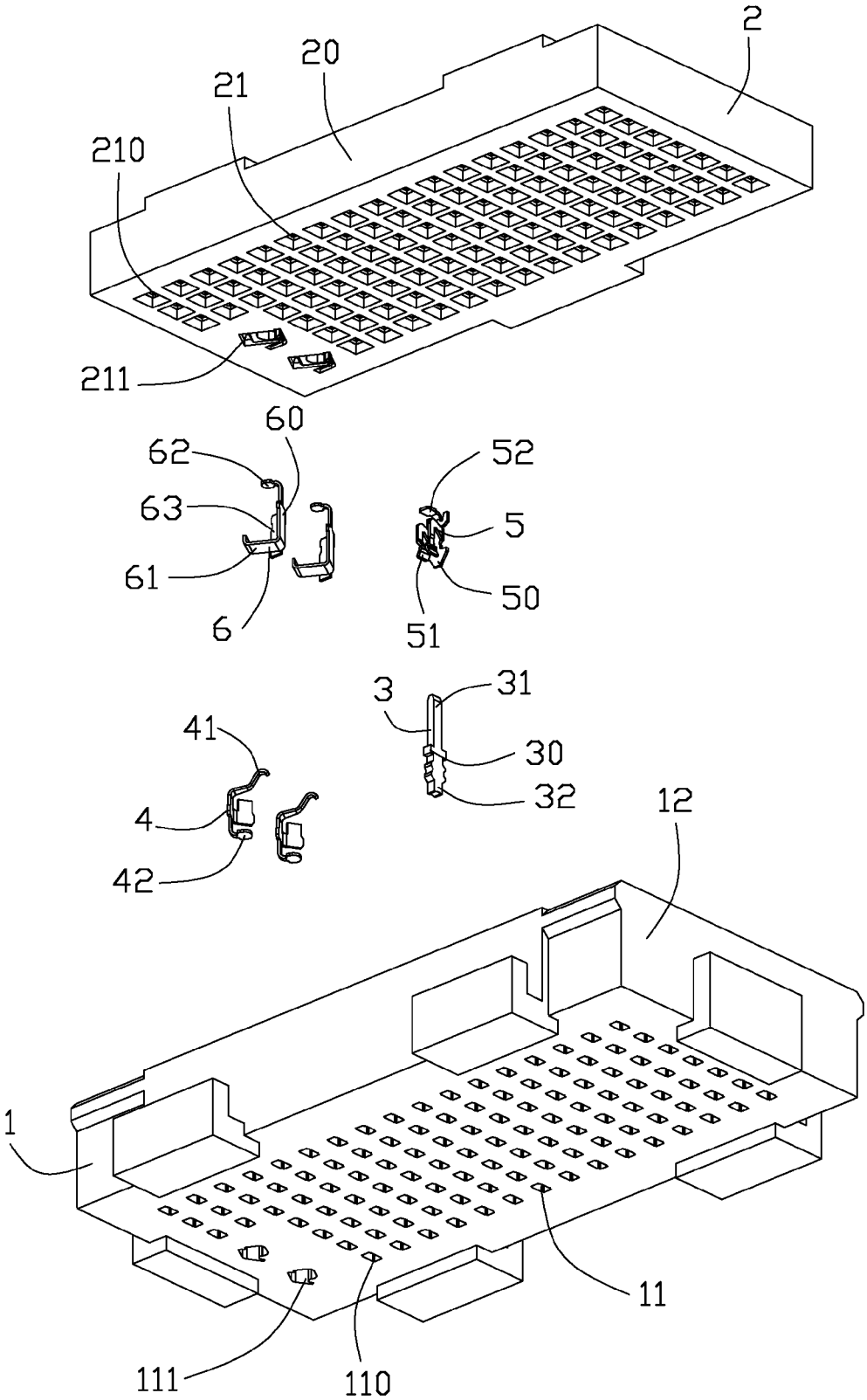
FIG. 5 is an assembled view of the electrical connector assembly as shown in FIG. 3.
Figure 6:
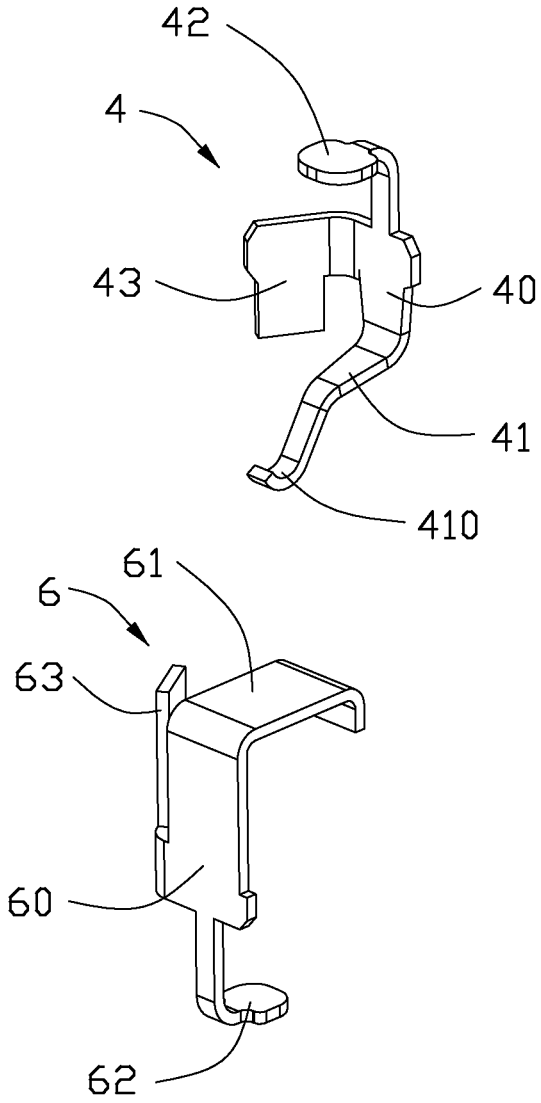
FIG. 6 is an isometric view of the second contact and the fourth contact.

Referring to FIG. 5, each of the first contacts 3 is configured to a line shape and includes a first body portion 30, a first contacting portion 31 extending upwardly from the first body portion 30 and a first soldering portion 32 extending downwardly from the first body portion 30. Referring to FIGS. 5-6, each of the second contacts 4 includes a second body portion 40, a spring portion 41 extending upwardly from the second body portion 40, a second soldering portion 42 extending downwardly from the second body portion 40 and a position portion 43 extending from one side of the second body portion 40. The end of the spring portion 41 defines a second contacting portion 410. When being assembled to the first insulating housing 1, the first contacting portion 31 is higher than the second contacting portion 410.

Figure 4:
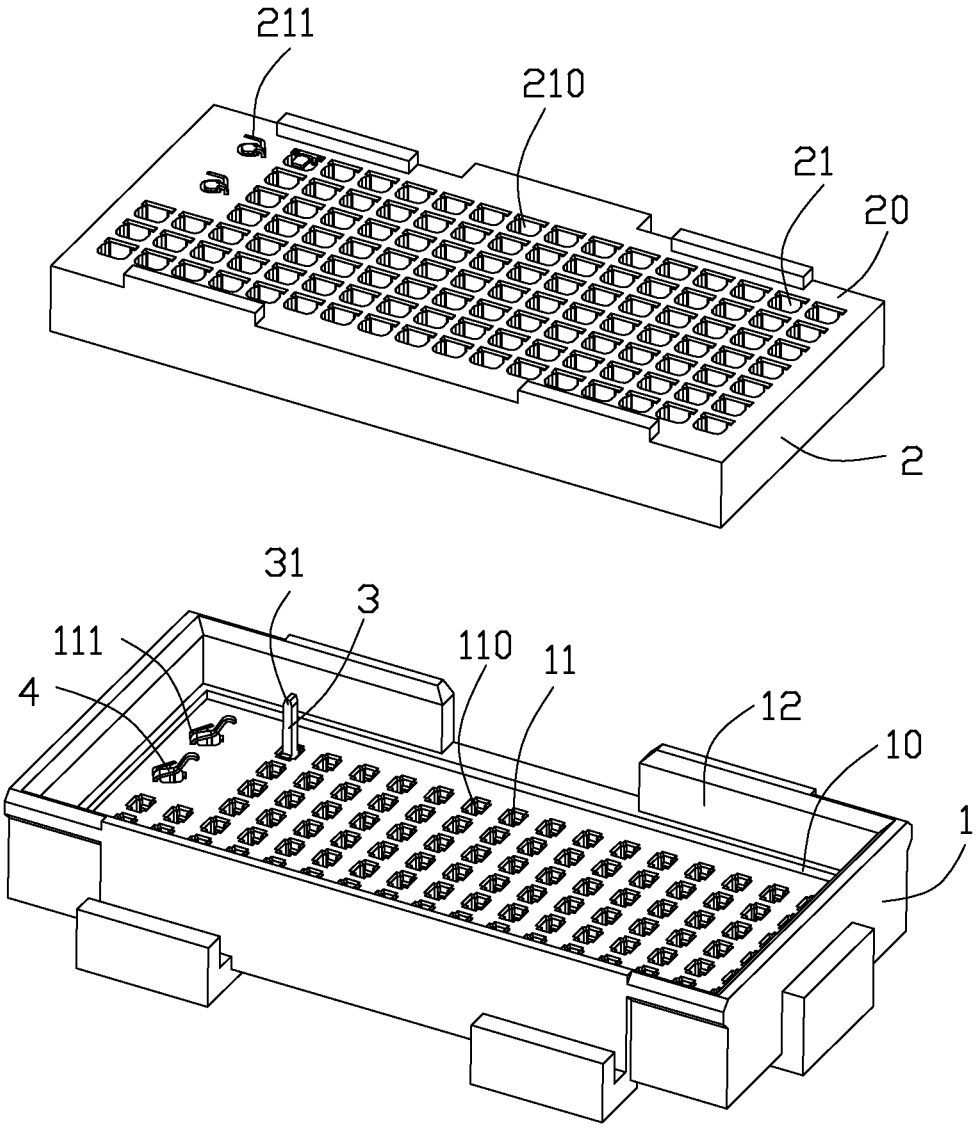
FIG. 4 is an exploded view of the first electrical connector and the second electrical connector.
Figure 7:
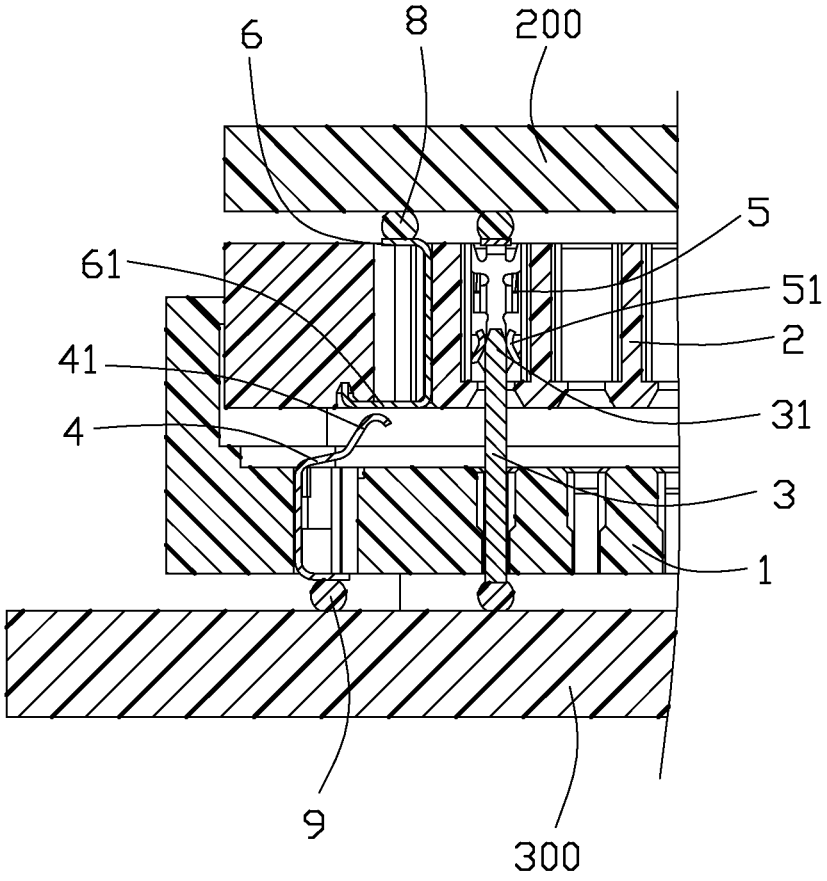
FIG. 7 is a cross-sectional view showing the second contact not contact with the fourth contact.

Referring FIG. 4 and FIG. 7, the second electrical connector includes a second insulating housing 2, a plurality of third contacts 5 and a plurality of fourth contacts 6 received in the second insulating housing 2. The second insulating housing 2 includes a plurality of third passageways 210 and a plurality of fourth passageways 211 penetrating the second insulating housing 2. The third contacts 5 receive in the third passageways 210, the fourth contacts 6 receive in the fourth passageways 211.

Referring to FIGS. 5-6, each of the third contacts 5 includes a third body portion 50, a pair of spring arms 51 extending from the two opposite ends of the body portion 50 and a third soldering portion 52 extending from the third body portion 50. Each of the fourth contacts 6 includes a fourth body portion 60, a press portion 61 and a fourth soldering portion 62 extending from two opposite ends of the fourth body portion 60 and a locating portion 63 extending from one side of the fourth body portion 60.

Figure 3:
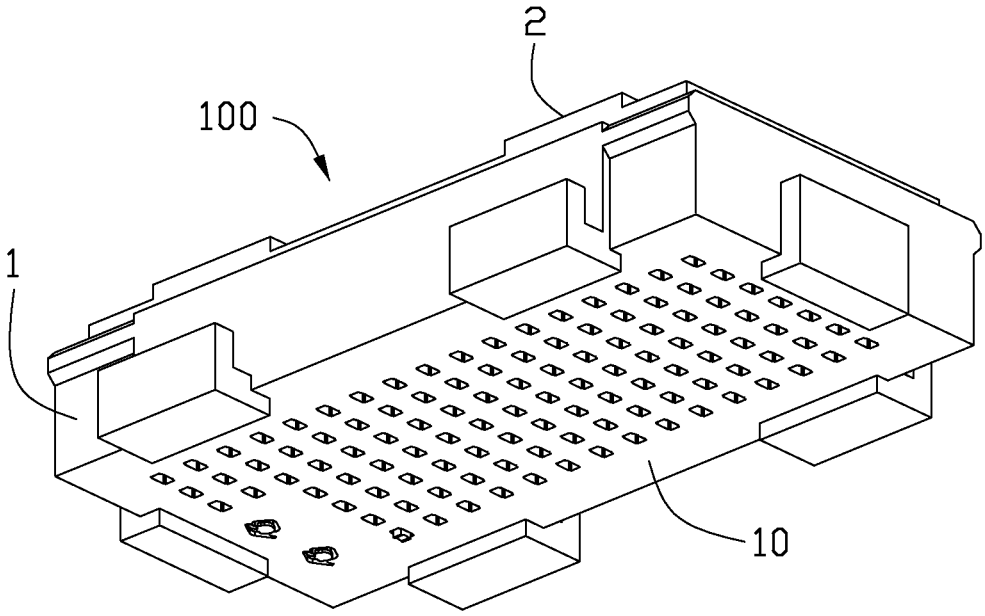
FIG. 3 is an assembled view of the electrical connector assembly as shown in FIG. 1.
Figure 8:
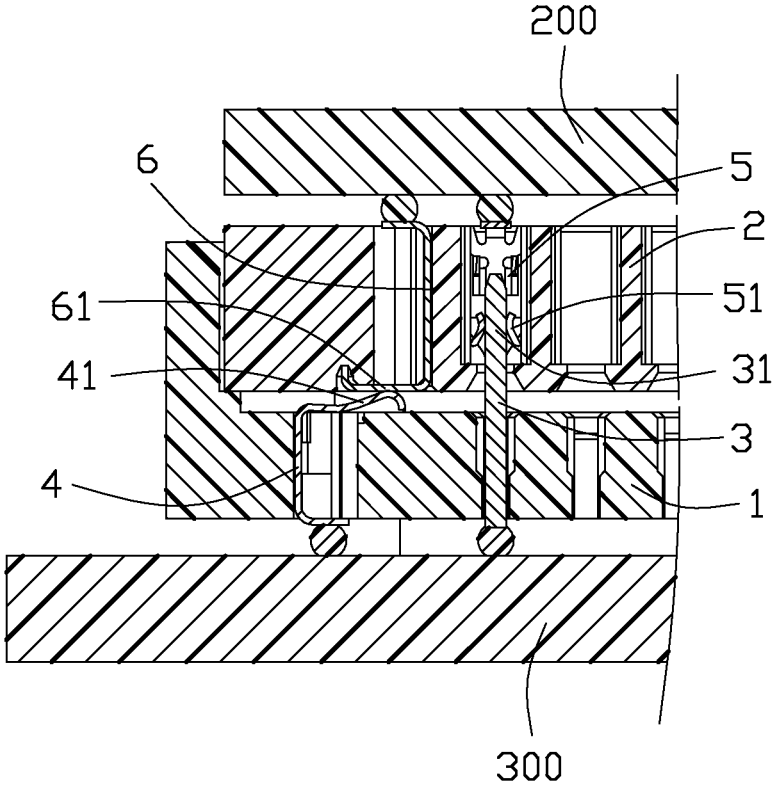
FIG. 8 is a cross-sectional view showing the second contact contacting with the fourth contact.

Referring to FIG. 3 and FIGS. 7-8, the first contacts 3 and the second contacts 4 are soldered to the substrate 300 through solder balls 9, the third contacts 5 and the fourth contacts 6 are soldered to the package 200 through solder balls 8. When assemble the first electrical connector to the second electrical connector, firstly, the first contacting portions 31 of the first contacts 3 are inserted into the space between the pair of spring arms 51 of the third contacts 5 and make an electrical connection between the first contacts 3 and the third contacts 5, however the second contacts 4 are disconnected with the fourth contacts 6; secondly, press the first electrical connector to make the second contacts 4 contact the fourth contacts 6, the press portions 61 contact the second contacting portions 410 of the second contacts 4 and press the spring portions 41 to deform and establish a robust electrical connection between the second contacts 4 and the fourth contacts 6.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector assembly for connecting a package to a substrate, comprising:

a first electrical connector for connecting the substrate and including a first insulating housing, a plurality of first contacts and a plurality of second contacts received in the first insulating housing; and a second electrical connector for connecting the package and including a second insulating housing, a plurality of third contacts and a plurality of fourth contacts received in the second insulating housing; wherein the third contact includes a pair of spring arms, the first contact includes a first contacting portion inserted into the space between the pair of spring arms and contact with the spring arms; wherein the second contact includes a spring portion with a second contacting portion at the end thereof, the fourth contact includes a press portion contacting the second contacting portion and press the spring portion to be deformed; wherein when the first contacts and the second contacts are assembled to the first insulating housing, the first contacting portion is higher than the second contacting portion; wherein the first insulating housing includes a main portion and a plurality of sidewalls extending upwardly from the main portion, the main portion and the sidewalls form a receiving space for receiving the second insulating housing; wherein the first contacts and the second contacts are soldered to the substrate through solder balls, the third contacts and the fourth contacts are soldered to the package through solder balls.

2. An electrical connector assembly for connecting a package to a substrate, comprising:

a first electrical connector for connecting the substrate and including a first insulating housing, a plurality of first contacts and a plurality of second contacts received in the first insulating housing; and a second electrical connector for connecting the package and including a second insulating housing, a plurality of third contacts and a plurality of fourth contacts received in the second insulating housing; wherein when the first electrical connector being assembled to the second electrical connector, in a first state, the first contacts connect with the third contacts and the second contacts disconnect with the fourth contacts, in a second state, the first contacts connect with the third contacts and the second contacts also connect with the fourth contacts; wherein the third contact includes a pair of spring arms, the first contact includes a first contacting portion inserted into the space between the pair of spring arms and contact with the spring arms; wherein the second contact includes a spring portion with a second contacting portion at the end thereof, the fourth contact includes a press portion press contacting the second contacting portion and press the spring portion to be deformed; wherein the first contacts and the second contacts are soldered to the substrate through solder balls, the third contacts and the fourth contacts are soldered to the package through solder balls.

3. An electrical connector assembly comprising:

a first connector including a first insulative housing equipped with a plurality of first contacts and one detecting contact; and a second connector including a second insulative housing equipped with a plurality of second contacts and one detecting terminal; wherein the first connector and the second connector are configured to be mated with each other in a mating direction, the first contacts are mated with the corresponding second contacts with a long mating stroke while the detecting contact is mated with the detecting terminal with a short mating stroke only after the long stroke occurs: wherein an engagement between the detecting contact and the detecting terminal occurs in the mating direction while that between the first contact and the corresponding second contacts occurs in a transverse direction perpendicular to said mating direction; wherein the detecting contact is transversely spaced from the first contacts with regard to a mating face of the first housing which is perpendicular to said mating direction; wherein the detecting contact is deflectable while the first contacts are stationary; wherein the detecting terminal is stationary while the second contacts are deflectable; wherein both the detecting contact and the first contacts extend beyond the mating face of the first housing while both the detecting terminal and the second contacts are essentially terminated around a mating face of the second housing.

4. The electrical connector assembled as claimed in claim 3, wherein the detecting contact is of an LGA (Land Gird Array) type while the first contact is of an LIF (Less Insertion Force) type.

5. The electrical connector assembly as claimed in claim 3, wherein the second housing is essentially mostly received in the first housing.

6. The electrical connector assembly as claimed in claim 3, wherein both said first connector and said second connector are mounted corresponding printed circuit boards, respectively, in said mating direction.

* * * * *